US005887916A

United States Patent [19]

Finkelstein et al.

[11] Patent Number: 5,887,916

[45] Date of Patent: Mar. 30, 1999

[54] SAFETY DOOR LATCH FOR PRESSURIZED OVENS

[75] Inventors: Burl Finkelstein; Mark Kennedy, both of Newnan, Ga.

[73] Assignee: Kason Industries, Inc., Shenandoah, Ga.

[21] Appl. No.: 938,949

[22] Filed: Sep. 25, 1997

[51] Int. Cl.[6] ..... E05C 3/04

[52] U.S. Cl. ..... 292/241; 292/240; 292/DIG. 69; 292/202

[58] Field of Search ..... 292/DIG. 69, 202–204, 292/240–241, 197, 40; 126/389, 21 R, 21 A, 20; 220/314–316, 324, 573.1, 360, 366.1, 318

[56] References Cited

U.S. PATENT DOCUMENTS

| | | | |
|---|---|---|---|
| 2,094,779 | 10/1937 | Donaldson | 29/84 |
| 2,394,784 | 2/1946 | Kelly | 292/240 |
| 3,005,065 | 10/1961 | Jellies | 292/DIG. 69 |
| 3,893,722 | 7/1975 | Galbreath et al. | 292/240 |
| 4,082,078 | 4/1978 | Thuleen et al. | 126/197 |
| 4,593,945 | 6/1986 | Arute et al. | 292/DIG. 69 |
| 4,604,878 | 8/1986 | Todd et al. | 70/139 |
| 4,838,586 | 6/1989 | Henne | 292/113 |
| 4,960,297 | 10/1990 | Bouse et al. | 292/223 |
| 4,995,313 | 2/1991 | Delau et al. | 99/467 |
| 5,022,380 | 6/1991 | Faurel et al. | 125/190 |
| 5,197,226 | 3/1993 | Gayhart, Jr. et al. | 292/241 |
| 5,219,193 | 6/1993 | Pilltingsrud | 292/240 |
| 5,522,656 | 6/1996 | Jenkins | 292/79 |

OTHER PUBLICATIONS

Non Venting Cam Latch Model 812 Kason Industries, Inc., Shenandoah Georgia Drawing No. Z–37024, 1996.

*Primary Examiner*—Flemming Saether
*Assistant Examiner*—Teri Pham
*Attorney, Agent, or Firm*—Kennedy, Davis & Kennedy, PC

[57] ABSTRACT

A safety door latch 10 has a base 12 with a shaft 24. A venting disc 30 is rotatably mounted on the base shaft. A lever 50 with a strike locking cam 54 is mounted on the base shaft over the venting disc. Lugs 23, 32 provide for limited relative movements of the locking cam with respect to the venting disc in conjunction with spring bias detenting balls 44.

6 Claims, 3 Drawing Sheets

SAFETY DOOR LATCH FOR PRESSURIZED OVENS

TECHNICAL FIELD

This invention relates generally to latches and particularly to safety latches for use in pressurized chambers such as steam ovens.

BACKGROUND OF THE INVENTION

As is known, various types of structures have doors with latches for securing the doors closed. In their simplest form, latches for doors commonly have a bar and a catch mounted on a door and door jamb. Either the bar or the catch is pivotably mounted for movement between a bar holding and bar releasing position. For example, with simple gate latches one merely lifts a pivotable bar or catch to release it from the other member. Upon swinging the gate back to its closed position, a camming leading edge of at least one member causes one member to be cammed over the other member and then fall behind and into a held position.

Latches on other structures such as pressurized oven doors, refrigerator doors and the like are of more sophisticated design for enhanced safety and reliability. For example, the camming lever latch is generally the preferred latching mechanism for doors of pressure chambers because it provides for good gasket compression and sealing of the door to maintain internal chamber conditions at a desired level of isolation from ambience. Sealing of pressurized chambers is typically provided by use of a rubber gasket which lines the perimeter of the chamber door or opening. When using a camming lever latch, engagement of a camming member mounted on the chamber door with a catch mounted on the door jamb, causes the door to be drawn toward the jamb with positive force providing firm gasket compression. This in turn provides superior sealing of the door. However, when the door of such a pressurized oven chamber is rapidly opened super heated steam can suddenly escape and burn the operator. To reduce this hazard some manufacturers have developed devices which allow for only limited opening of the chamber door in a first door opening stage while yet restraining it to allow circulating steam to be vented from the chamber in a controlled manner before the door is fully opened in a second stage. For instance, some safety doors use a separate edge-mounted mechanical device which requires a second operator action to fully release the chamber door. Other devices provide two stage opening with a single latching unit by use of a latching hook that engages a latching pin in alternate positions, or by use of a dual position roller that engages a double latch strike. None of these devices, however, provides the firm gasket compression and sealing of a camming lever type latch in a single unit.

Accordingly, there remains a need for a safety door latch for pressurized ovens that provides the sealing alacrity of a camming lever latch and yet also a two-stage opening operational feature. It is to the provision of such a latch that the present invention is primarily directed.

SUMMARY OF THE INVENTION

Briefly described, a safety door latch is provided for a pressurized oven having a strike mounted adjacent to the over door opening. In its preferred form the safety door latch comprising a base adapted to be mounted on the oven door from which a shaft extends. A venting disc is rotatably mounted on the base shaft and has a portion sized to engage the strike. A lever having a hub is rotatably mounted on the base shaft over the venting disc from which a handle extends and from which a locking cam extends for rotatable engagement with the strike. The latch also has means for coupling the lever with the venting disc in different relative angular positions in varying the angular position of the lever locking cam with respect to the venting disc portion in response to manual movements of the lever handle. By varying this relative position the locking cam may operatively engage the strike in a door closed position, the venting disc may operatively engage the strike in a door venting position, and neither the cam nor venting disc may engage the strike in a door open position, all being done in a safe sequence of operations.

DETAILED DESCRIPTION

Figure 1:
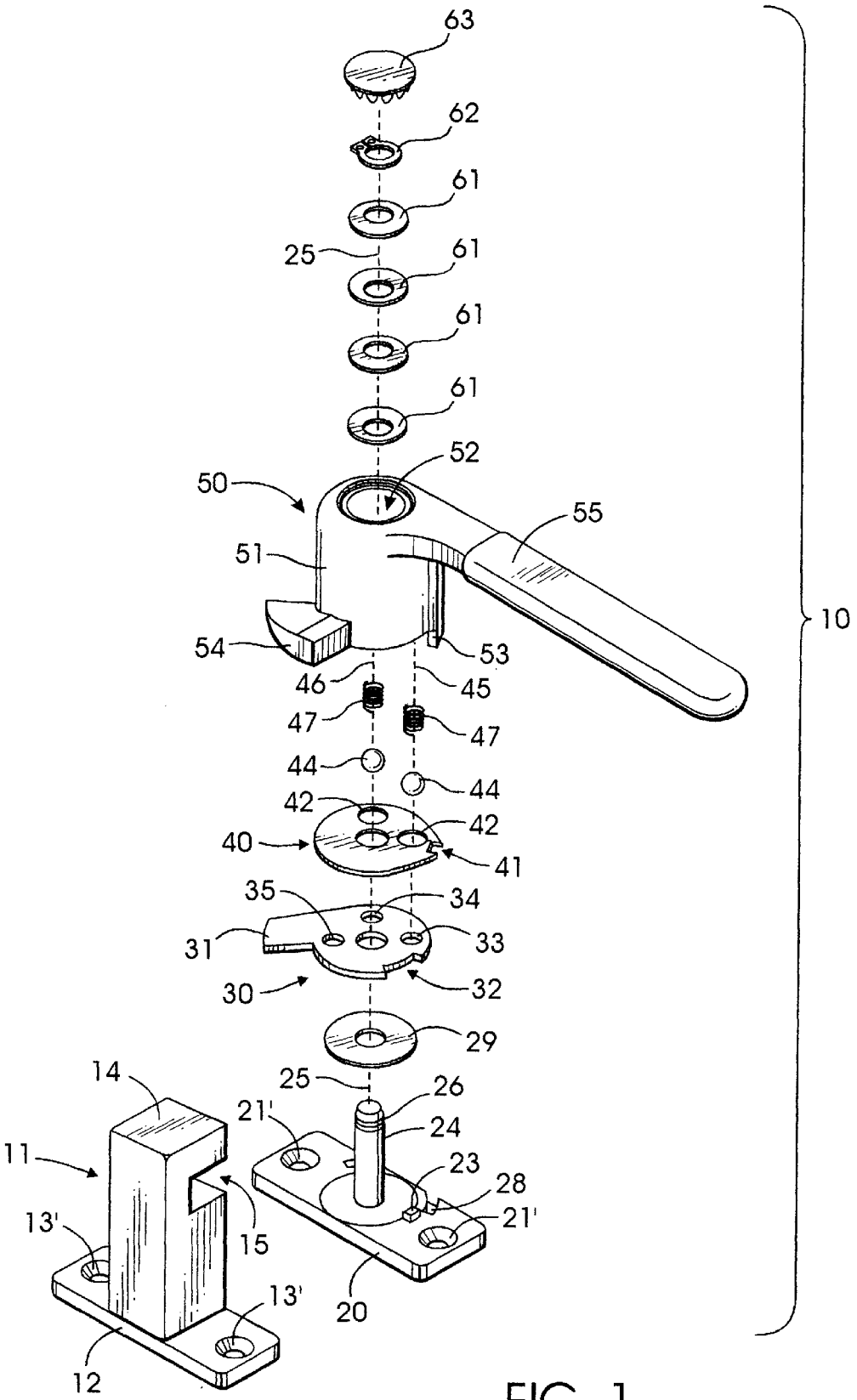
FIG. 1 is an exploded view of a safety door latch embodying principles of the invention in a preferred form shown positioned adjacent to a strike.

Referring now in more detail to the drawing, there is shown a safety door latch 10 and a strike 11. Strike 11 has a base 12 adapted to be mounted to a door jamb by screws 13 in screw holes 13'. A block 14 extends from the base 12 which has a slot 15 near its end opposite the base. The safety door latch 10 also has a base 20 which is adapted to be mounted on an oven door by screws 21 in screw holes 21'. The base has a lug 23 and also a shaft 24 having an axis 25. Shaft 24 has a groove 26 in its end opposite of the base 20. The base also has a raceway 28 that is radially spaced from the shaft axis 25 and which arcuately extends a radial distance of 120° about the shaft axis.

A venting disc 30 is rotatably mounted on the base shaft over a washer 29. The venting disc 30 has an outwardly extending lobe 31 and a notch 32 which extends arcuately 30' along the disc periphery. The venting disc is mounted on shaft 24 with base lug 23 located within the notch 32. The venting disc 30 has three holes 33, 34 and 35 radially spaced from the axis 25.

A friction washer 40 is also rotatably mounted on the base shaft 24 over the venting disc 30. It has a notch 41 in an outward extension portion. The friction washer also has two holes 42 radially spaced from axis 25 which receive two detent balls 44 along axes 45 and 46. Note that axis 25 is shown superimposed upon axis 46 in FIG. 1 due to the orientation of the drawing view but is actually spaced from it. Two compression springs 47 are held by receptacles (not shown) in a lever 50 mounted on the base shaft which bias the detent balls 44 downwardly along axis lines 45 and 46. The detenting balls 44 are of a size sufficient to rest within friction washer holes 42 but sit atop venting disc holes 33, 34 and 35, two at a time.

The lever 50 has a cylindrical hub 51 with a passage 52 therethrough that receives the shaft 24 in being rotatably mounted thereon over the friction washer 40. The periphery of the hub 51 has a downwardly extending lug 53 which passes through the friction washer notch 41 to reside within the base race 28. Lever 50 also has an outwardly extending, ramped, locking cam 54 and a handle 55. Spring washers 61 are mounted on the shaft 24 within the lever hub 51. A retaining ring 62 is snapped into the shaft groove 24 to compress spring washers 61 and compression springs 47 and to hold all of the parts together as an assembled unit. A finishing plug 63 is snapped into a receiver in the top end of the lever.

OPERATION

Figure 2:
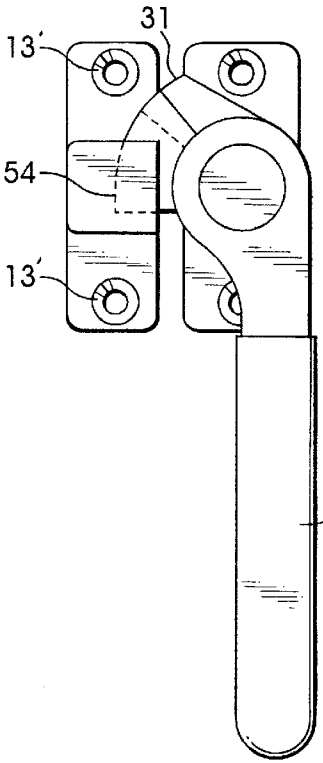
Figure 5:
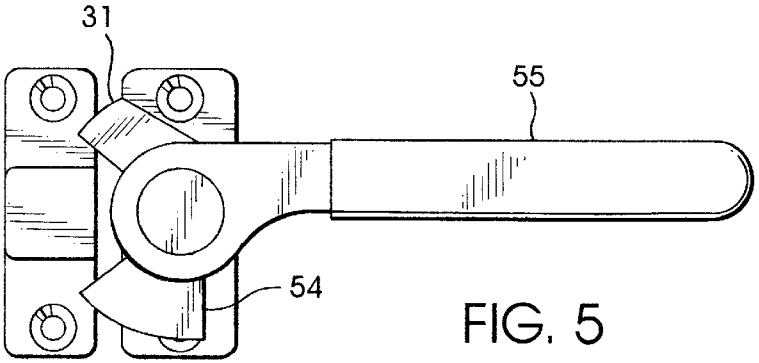
Figure 6:
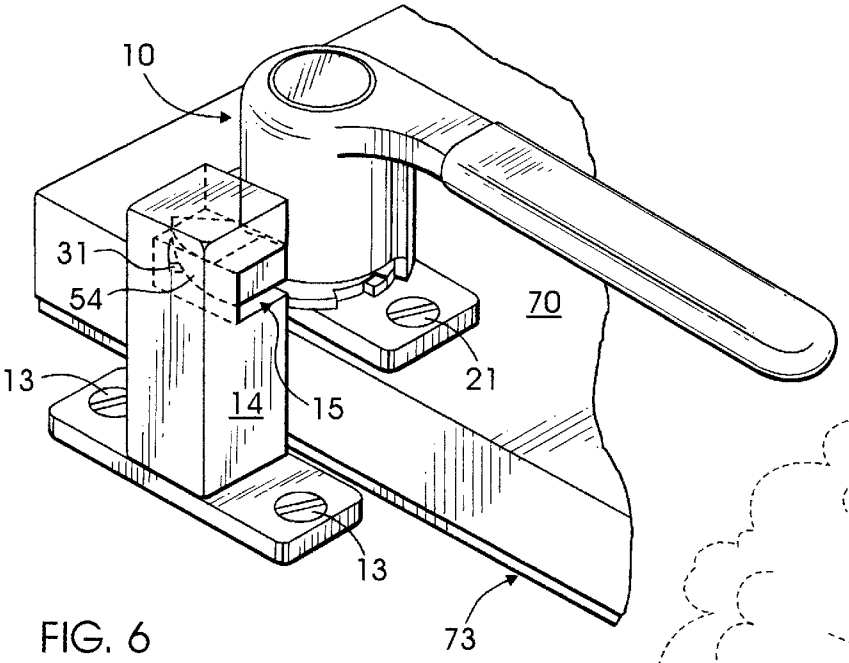
FIG. 6 is a perspective view of the safety door latch shown mounted on a pressurized oven donor latched to the strike.

FIGS. 2 through 7 illustrate operation of the safety door latch. FIGS. 2 and 6 show the safety door latch 10 in its fully closed position. In this position, the locking cam 54 partially overlays the venting lobe 31 and is positioned within their strike slot 15 firmly compressing the door rubber seal 73. With the safety door latch in this fully closed position, the venting disc and lever are restricted to counterclockwise rotation only due to base lug 23 being in abutment with the clockwise limit of the venting disc notch 32 and with the lever lug 53 in abutment against the clockwise limit of base race 28. Here the detent balls 44 are pressed into the venting disc holes 33 and 34 by compression springs 47 causing venting disc 30 to rotate with rotation of the lever 50.

Figure 3:
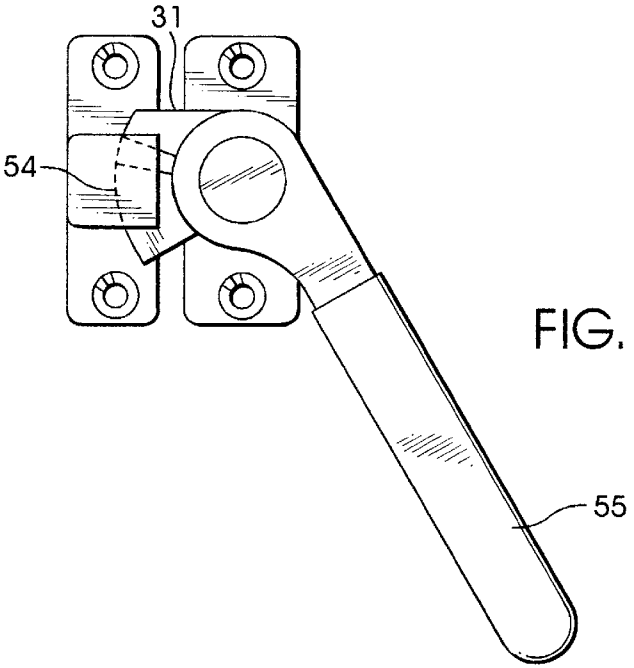
FIGS. 2–5 are four front views of the safety door latch shown in four different operative positions.
Figure 7:
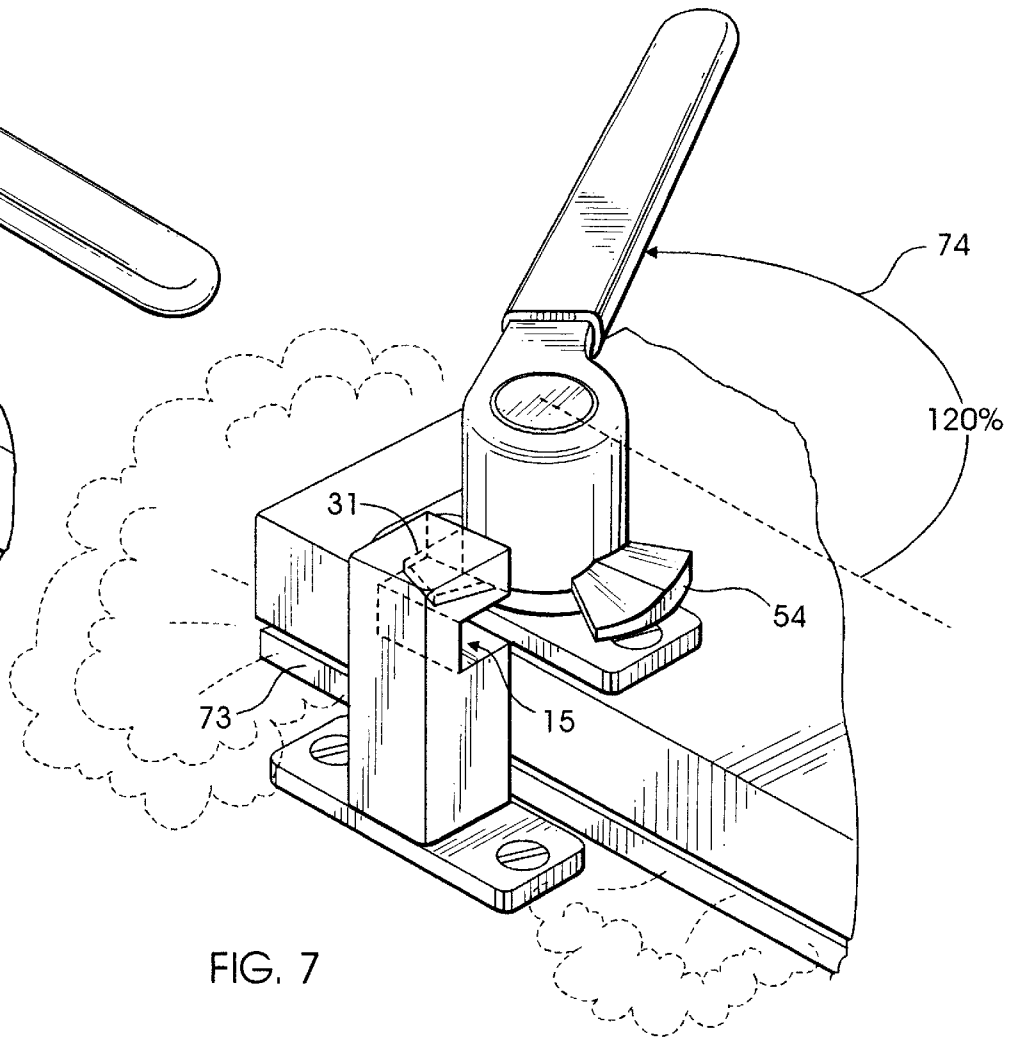
FIG. 7 is a perspective view of the latch and a strike in a oven venting position.

As shown in the positions, during the first 30° of counterclockwise rotation of lever handle 55 and lever 50, the locking cam 54 is moved away from within the strike slot 15 and venting disc lobe 31 is driven to a position within the strike slot. As shown in FIG. 3 at their 30° of rotation position, the base lug 23 abuts the counterclockwise limit of venting disc notch 32 thus restricting the venting disc rotation only in a clockwise direction. Continued counterclockwise rotation of the lever handle causes the upper friction washer 40 to rotate with lever 50 due to the interlocking of the friction washer notch 41 with the lever lug 53, while the venting disc is held in a fixed position. This causes the friction washer to drive the detent balls out of the venting disc holes 33 and 34 and counterclockwise with the friction washer and lever. The locking cam 54 moves away from the venting disc lobe to the position shown in FIG. 4. With the locking cam now disengaged from the strike, the rubber door seal 73 decompresses and urges the door slightly open bringing the venting lobe 31 against the top of the strike slot which allows steam to vent, as shown in FIG. 7.

Figure 4:
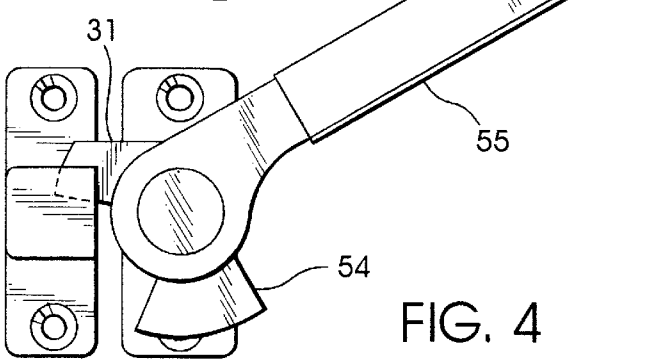

Counterclockwise rotation of the lever is limited to 120° by abutment of the lever lug 53 against the counterclockwise limit of the bare race 28. At this 120° limit the detent balls 44 occupy a new position in venting disc holes 34 and 35, instead of in holes 33 and 34, thus holding the venting lobe 31 in a new set position angularly spaced from the locking cam 54 as shown in FIGS. 4 and 5. Reverse rotation of the lever 50 now in a clockwise direction moves the venting disc and lobe and the locking cam together under the frictional forces provided by the springs 47 for 30°. This brings the lever to the position of FIG. 5 where neither the venting disc lobe nor the locking cam engages the strike. Thus here the door may be fully opened and reclosed.

Continued clockwise rotation of the lever handle 55 causes base lug 23 to abut the clockwise limit of the venting disc notch 32 causing the disc to remain in a fixed position while friction washer 40, interlocked with lever 50, moves in a clockwise direction. This causes the friction washer holes 42 to drive the detenting balls 44 back to their original position in the venting disc holes 33 and 34. This further causes the locking cam to become partially overlaid with the venting lobe 31 and again to engage strike slot 15 and compress the seal 73 in a door fully closed position.

It thus is seen that a safety door latch is now provided for pressurized ovens and the like as a single unit form. The latch may be manually moved by its handle alone between door closed, chamber venting, and door opened positions. As it cannot be moved from a door closed to a door opening position without passing through the venting position, this provides for safe operation in addition to ease of operation.

While the invention has been described in preferred form, it should be understood that many modifications, additions and deletions may be made thereto without departure from the spirit and scope of the invention as set forth in the following claims.

We claim:

1. A safety door latch for a pressurized oven having a strike mounted adjacent to the oven door opening, and with the safety door latch comprising a base adapted to be mounted on the oven door from which a shaft extends; a venting disc rotatably mounted on said base shaft having a portion thereof adapted to engage the strike; a lever having a hub rotatably mounted on said base shaft over said venting disc from which a handle outwardly extends and from which a locking cam outwardly extends for rotatable engagement with the strike; and means for coupling said lever with said venting disc in different relative angular positions to vary the angular position of said lever locking cam with respect to said venting disc portion.

2. The safety door latch of claim 1 wherein said venting disc has a race and said base has a lug that extends into said venting disc race to limit rotation of said venting disc upon said base.

3. The safety door latch of claim 1 wherein said base has a race and wherein said lever has a lug that extends into said base race to limit rotation of said lever upon said base.

4. The safety door latch of claim 1 wherein said venting disc strike engaging portion is an outwardly extending disc lobe.

5. A safety door latch for a pressurized oven having a strike mounted adjacent to the oven door opening, and with the safety door latch comprising, in combination, a base adapted to be mounted on the oven door from which a shaft extends along an axis and from which a lug extends; a venting disc rotatably mounted on said base shaft and having a race in which said base lug extends and having an outwardly extending lobe for engaging the strike; a lever having a lug rotatably mounted on said base shaft over said venting disc from which a handle extends and from which a locking cam extends for rotatable engagement with the strike; and spring biased detent means for coupling said lever with said venting disc in a plurality of relative rotary positions to alter the relative rotary position of said lever locking cam with respect to said venting disc lobe.

6. The safety door latch of claim 5 wherein said venting disc has a surface with a set of detents therein, and wherein said detent means comprises a plurality of spring biased balls biased towards said venting disc surface.

* * * * *